US009915964B2

(12) United States Patent
Kim

(10) Patent No.: US 9,915,964 B2
(45) Date of Patent: Mar. 13, 2018

(54) SEMICONDUCTOR APPARATUS

(71) Applicant: SK hynix Inc., Icheon-si Gyeonggi-do (KR)

(72) Inventor: Jong Sam Kim, Icheon-si (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 478 days.

(21) Appl. No.: 14/591,054

(22) Filed: Jan. 7, 2015

(65) Prior Publication Data

US 2016/0091911 A1 Mar. 31, 2016

(30) Foreign Application Priority Data

Sep. 25, 2014 (KR) ..... 10-2014-0128433

(51) Int. Cl.
*H01H 35/14* (2006.01)
*G05F 1/656* (2006.01)

(52) U.S. Cl.
CPC ..... *G05F 1/656* (2013.01)

(58) Field of Classification Search
CPC ..... G05F 1/656
USPC ..... 307/117, 116; 327/512, 513
See application file for complete search history.

(56) References Cited

U.S. PATENT DOCUMENTS

2010/0110815 A1* 5/2010 Lee ..... G11C 5/143 365/211
2011/0169552 A1* 7/2011 Jeong ..... G01K 3/005 327/512

FOREIGN PATENT DOCUMENTS

KR 1020070079111 A 8/2007
KR 1020140028507 A 3/2014

* cited by examiner

*Primary Examiner* — Thomas Skibinski
(74) *Attorney, Agent, or Firm* — William Park & Associates Ltd.

(57) ABSTRACT

A semiconductor apparatus includes a control block that generates a first control signal, a second control signal, and a heating enable signal in response to an enable signal and a heating control signal, a temperature measurement block that generates a temperature code corresponding to temperature in response to the first and second control signals, a heater that generates heat while the heating enable signal is being enabled, a code latch block that stores the temperature code in response to the first and second control signals, and outputs a first code and a second code, a control code generation circuit that generates a signal by performing an operation on the first and second codes, and generates a control code by comparing the signal with a preset code, and a reference voltage generation circuit configured to change a voltage level of a reference voltage in response to the control code.

19 Claims, 6 Drawing Sheets

SEMICONDUCTOR APPARATUS

CROSS-REFERENCES TO RELATED APPLICATION

The present application claims priority under 35 U.S.C. § 119(a) to Korean application number 10-2014-0128433 filed on Sep. 25, 2014, in the Korean Intellectual Property Office, which is incorporated herein by reference in its entirety.

BACKGROUND

1. Technical Field

Embodiments of the present invention generally relate to a semiconductor integrated circuit, and more particularly, in one or more embodiments, to a semiconductor apparatus.

2. Related Art

A semiconductor apparatus, which is electrically connected to an external supply voltage, operates using an internal voltage generated from the external supply voltage.

The semiconductor apparatus contains transistors which may be in one of various conditions (e.g., cut-off, active, or saturation) according to the internal voltage applied thereto. The characteristics of the transistors, however, may vary with temperature changes. For example, current flowing between a drain and the source of the transistor may vary with temperature changes even if the internal voltages being applied to the gate and the source remain constant, and this variation may cause semiconductor apparatus to malfunction.

Therefore, if the voltage levels of the internal voltages are adjusted according to temperature, a chance of malfunctioning may decrease.

SUMMARY

In an embodiment of the present invention, a semiconductor apparatus includes: a control block that generates a first control signal, a second control signal, and a heating enable signal in response to an enable signal and a heating control signal; a temperature measurement block that generates a temperature code corresponding to temperature in response to the first and second control signals; a heater that generates heat for an enable period of the heating enable signal; a code latch block that latches the temperature code in response to the first and second control signals, and outputs a first code and a second code; a control code generation circuit that compares an operation result of the first code and the second code with a preset code, and generates a control code; and a reference voltage generation circuit that changes a voltage level of a reference voltage in response to the control code.

In an embodiment of the present invention, a semiconductor apparatus includes: a temperature code generation circuit that generates a first code corresponding to temperature before a heater operates and generates a second code corresponding to temperature after the heater operates, in response to an enable signal; a control code generation circuit that generates a control code in response to the first code and the second code; and a reference voltage generation circuit that generates a reference voltage having a voltage level corresponding to the control code.

BRIEF DESCRIPTION OF THE DRAWINGS

Features, aspects, and embodiments are described in conjunction with the attached drawings, in which.

DETAILED DESCRIPTION

Figure 1:
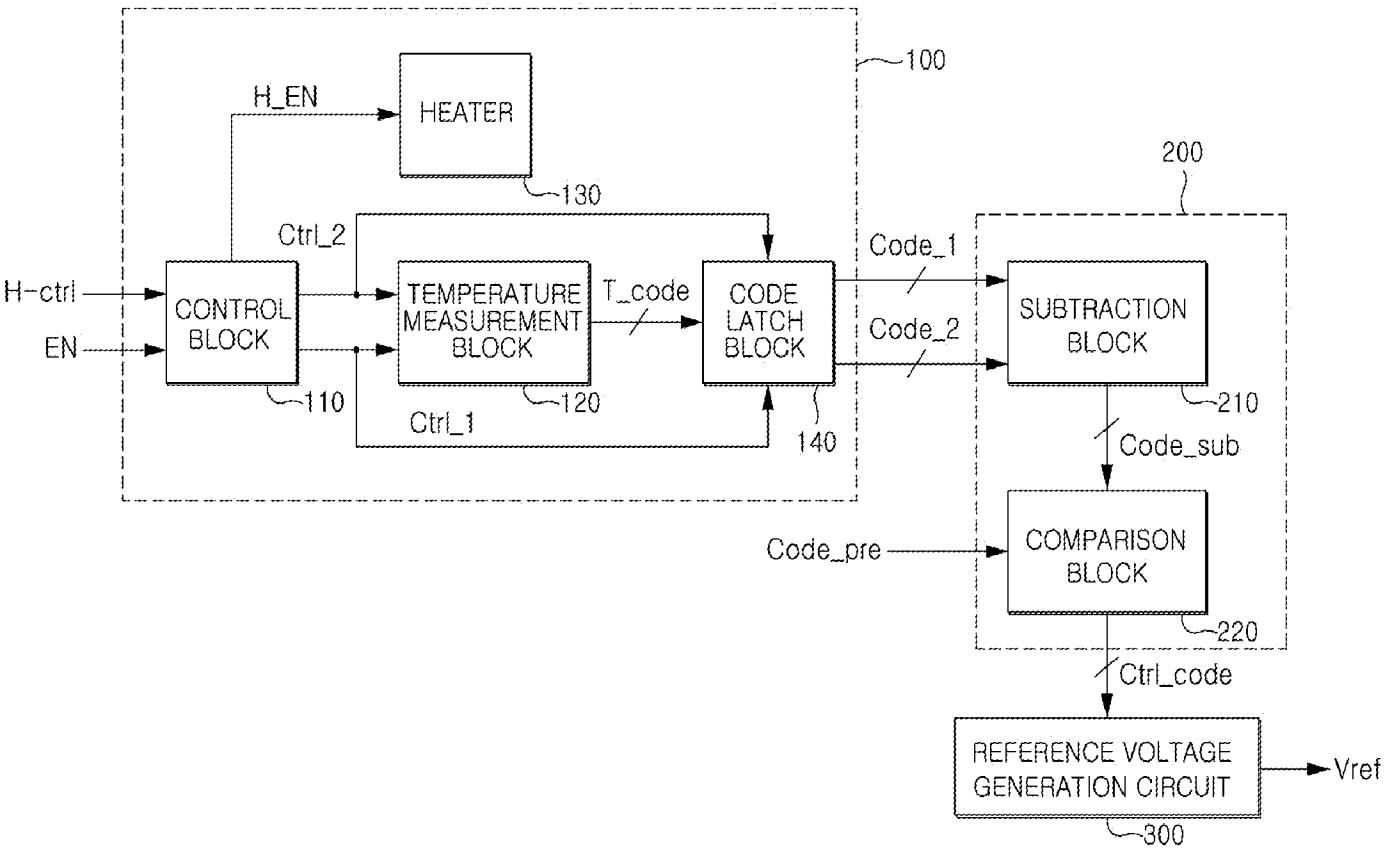
FIG. 1 is a configuration diagram of a semiconductor apparatus according to an embodiment of the present invention.

FIG. 1 is a configuration diagram of a semiconductor apparatus according to an embodiment of the present invention.

As illustrated in FIG. 1, a semiconductor apparatus according to an embodiment of the present invention includes a temperature code generation circuit 100, a control code generation circuit 200, and a reference voltage generation circuit 300.

The temperature code generation circuit 100 may generate a first code Code_1 corresponding to temperature before a heater 130 operates and generate a second code Code_2 corresponding to temperature after a heating operation of the heater 130 in response to an enable signal EN.

In an embodiment of the present invention, the temperature code generation circuit 100 includes a control block 110, a temperature measurement block 120, the heater 130, and a code latch block 140.

The control block 110 may generate a first control signal Ctrl_1, a second control signal Ctrl_2, and a heating enable signal H_EN in response to the enable signal EN. The first and second control signals Ctrl_1 and Ctrl_2 may be used to control the temperature measurement block 120 and the code latch block 140. The heating enable signal H_EN may be used to control the heater 130. For example, the control block 110 enables the first control signal Ctrl_1 when the enable signal EN is enabled, enables the heating enable signal H_EN after the first control signal Ctrl_1 is disabled, and enables the second control signal Ctrl_2 when the heating enable signal H_EN is disabled. The time period of the heating enable signal H_EN, for example, how long the heating enable signal H_EN is enabled may be determined in response to a heating control signal H__ ctrl.

The temperature measurement block 120 generates a temperature code T_code each corresponding to a certain temperature. For example, when any one of the first and second control signals Ctrl_1 and Ctrl_2 is enabled, the temperature measurement block 120 generates the temperature code T_code. In an embodiment of the present invention, when the first control signal Ctrl_1 is enabled, the temperature measurement block 120 generates the temperature code T_code corresponding to a first temperature value, and when the second control signal Ctrl_2 is enabled, the temperature measurement block 120 generates the temperature code T_code corresponding to a second temperature value.

The heater 130 may generate heat while the heating enable signal H_EN is being enabled.

The code latch block 140 may store the temperature code T_code in response to the first and second signals Ctrl_1 and Ctrl_2, and outputs the first and second codes Code_1 and Code_2. For example, the code latch block 140 may output the stored temperature code T_code as the first and second codes Code_1 and Code_2. For example, when the first control signal Ctrl_1 is enabled, the code latch block 140 stores the temperature code T_code and outputs the first code Code_1, and when the second control signal Ctrl_2 is enabled, the code latch block 140 stores the temperature code T_code and outputs the second code Code_2.

The control code generation circuit 200 may generate a control code Ctrl_code in response to the first code Code_1 and the second code Code_2. For example, the control code generation circuit 200 may generate a signal by performing an operation on the first code Code_1 and the second code Code_2, and generate the control code Ctrl_code by comparing the signal with a preset code Code_pre.

In an embodiment of the present invention, the control code generation circuit 200 includes a subtraction block 210 and a comparison block 220.

The subtraction block 210 may perform a subtraction operation on the first code Code_1 and the second code Code_2, and generates a subtraction code Code_sub.

The comparison block 220 compares the subtraction code Code_sub with the preset code Code_pre, and generates the control code Ctrl_code. For example, when the subtraction code Code_sub is equal to the preset code Code_pre, the comparison block 220 generates a control code Ctrl_code, which has a preset value, and when a code value of the preset code Code_pre is not equal to the subtraction code Code_sub, the comparison block 220 generates a control code Ctrl_code which has a smaller or larger value than the preset value.

The reference voltage generation circuit 300 generates a reference voltage Vref having a voltage level in response to the control code Ctrl_code. For example, the reference voltage Vref may have a voltage level corresponding to the control code Ctrl_code.

Figure 2:
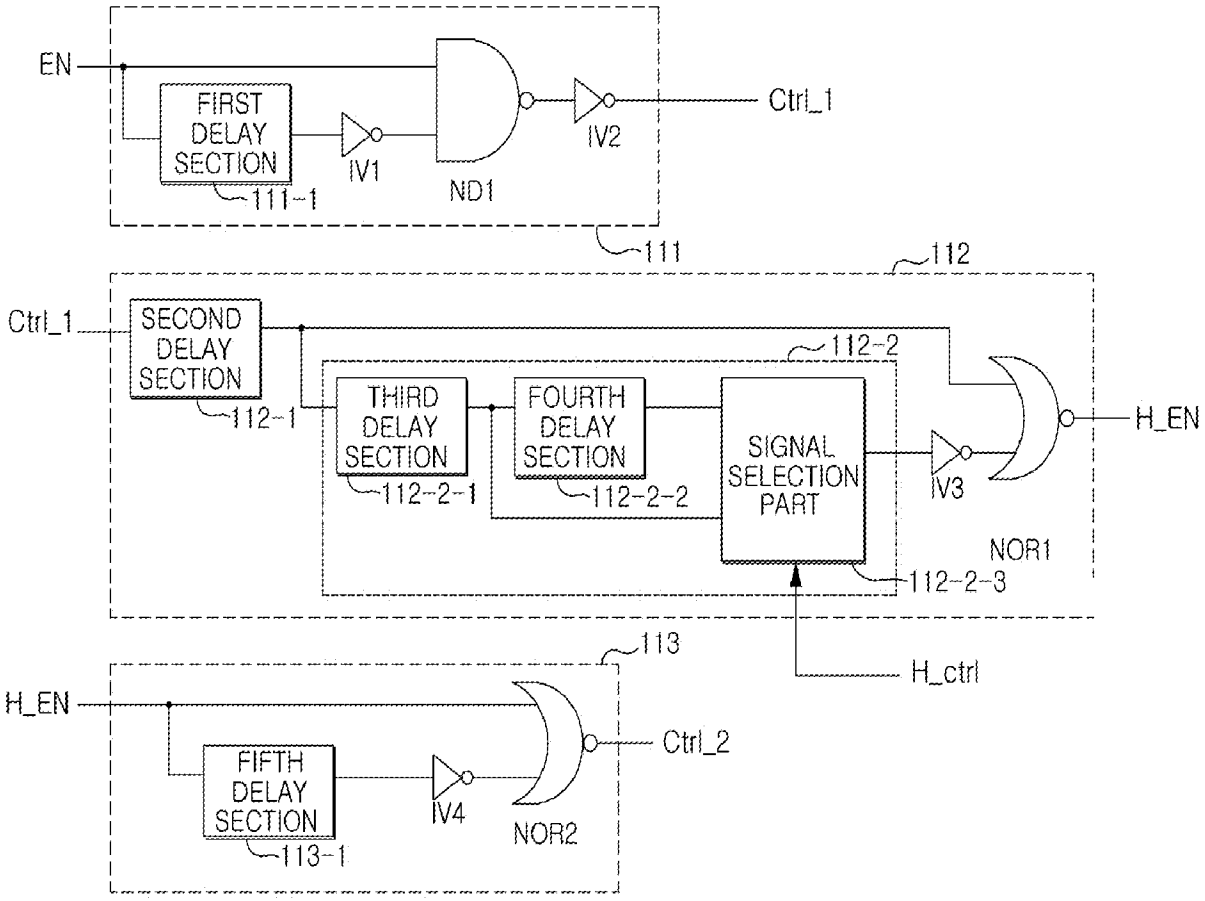
FIG. 2 is a configuration diagram of a control block of FIG. 1.

As illustrated in FIG. 2, the control block 110 according to an embodiment of the present invention includes a first control signal generation unit 111, a heating enable signal generation unit 112, and a second control signal generation unit 113.

The first control signal generation unit 111 may enable the first control signal Ctrl_1 when the enable signal EN is enabled. For example, when the enable signal EN is enabled, the first control signal generation unit 111 generates the first control signal Ctrl_1 that is enabled for a predetermined time.

In an embodiment of the present invention, the first control signal generation unit 111 includes a first delay section 111-1, first and second inverters IV1 and IV2, and a NAND gate ND1. The first delay section 111-1 may receive the enable signal EN and output a delayed enable signal EN. The first inverter IV1 may receive an output signal of the first delay section 111-1. The NAND gate ND1 may receive the enable signal EN and an output signal of the first inverter IV1. The NAND gate ND1 may perform NAND operation on the enable signal EN and an output signal of the first inverter IV1. The second inverter IV2 receives an output signal of the NAND gate ND1 and outputs the first control signal Ctrl_1.

The heating enable signal generation unit 112 may enable the heating enable signal H_EN when a predetermined time has passed after the first control signal Ctrl_1 is disabled. The duration during which the heating enable signal H_EN remains enabled may be determined in response to the heating control signal H__ ctrl.

In an embodiment of the present invention, the heating enable signal generation unit 112 includes a second delay section 112-1, a variable delay section 112-2, a third inverter IV3, and a first NOR gate NOR1. The second delay section 112-1 may receive the first control signal Ctrl_1 and output a delayed first control signal Ctrl_1. The variable delay section 112-2 may delay the delayed first control signal Ctrl_1. The delay time at the variable delay section 112-2 may vary according to the heating control signal H__ ctrl. The third inverter IV3 may receive an output signal of the variable delay section 112-2. The first NOR gate NOR1 may receive an output signal of the second delay section 112-1 and an output signal of the third inverter IV3, and outputs the heating enable signal H_EN. The variable delay section 112-2 may include third and fourth delay parts 112-2-1 and 112-2-2 and a signal selection part 112-2-3. The third delay part 112-2-1 may receive an output signal of the second delay section 112-1. The fourth delay part 112-2-2 may receive an output signal of the third delay part 112-2-1. The signal selection part 112-2-3 may output one of the output signal of the third delay part 112-2-1 and an output signal of the fourth delay part 112-2-2 to the third inverter IV3 in response to the heating control signal H__ ctrl.

The delay time of the variable delay section 112-2 may be determined according to the heating control signal H__ ctrl, and the delay time may correspond to the duration of the period when the heating enable signal H_EN is being enabled.

The second control signal generation unit 113 may enable the second control signal Ctrl_2 when the heating enable signal H_EN, which has been in a logic-high state, becomes logic-low.

The second control signal generation unit 113 may include a fifth delay section 113-1, a fourth inverter IV4, and a second NOR gate NOR2. The fifth delay section 113-1 may receive the heating enable signal H_EN. The fourth inverter IV4 may receive an output signal of the fifth delay section 113-1. The second NOR gate NOR2 may perform NOR operation on the heating control signal H__ ctrl and an output signal of the fourth inverter IV4, and outputs the second control signal Ctrl_2.

Figure 3:
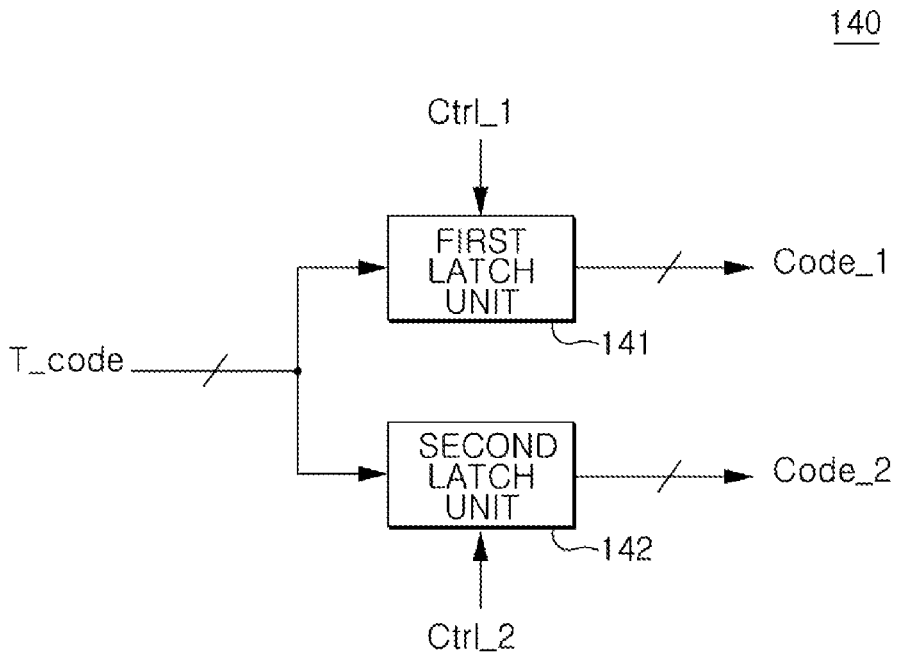
FIG. 3 is a configuration diagram of a code latch block of FIG. 1.

As illustrated in FIG. 3, the code latch block 140 according to an embodiment of the present invention includes a first latch unit 141 and a second latch unit 142.

The first latch unit 141 may store the temperature code T_code and output the first code Code_1 when the first control signal Ctrl_1 is enabled.

The second latch unit 142 may store the temperature code T_code and output the second code Code_2 when the second control signal Ctrl_2 is enabled.

Figure 4:
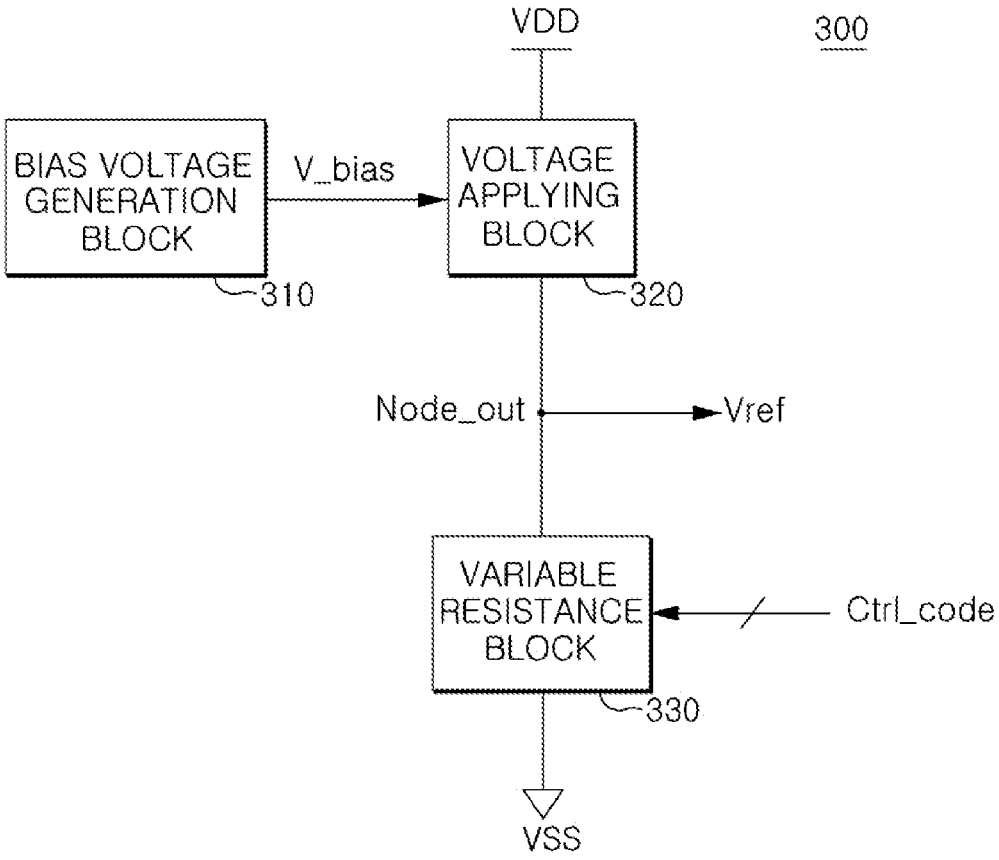
FIG. 4 is a configuration diagram of a reference voltage generation circuit of FIG. 1.

As illustrated in FIG. 4, the reference voltage generation circuit 300 according to an embodiment of the present invention includes a bias voltage generation block 310, a voltage applying block 320, and a variable resistance block 330.

The bias voltage generation block 310 may generate a bias voltage V_bias.

The voltage applying block 320, which is supplied with an external voltage VDD, may apply a voltage to an output node Node_out according to a voltage level of the bias voltage V_bias. For example, the voltage applying block 320 may generate, by using the external voltage VDD, a voltage, which has a voltage level corresponding to the voltage level of the bias voltage V_bias.

The variable resistance block 330 may be coupled to the output node Node_out and a ground terminal VSS. A resistance value of the variable resistance block 330 may vary according to the control code Ctrl_code. The voltage level of the reference voltage Vref, which is outputted from the output node Node_out, may be determined based on the voltage generated at the voltage applying block 320 and the resistance value of the variable resistance block 330.

The semiconductor apparatus according to an embodiment of the present invention may adjust the internal voltages according to the variation of temperature.

When the enable signal EN is enabled, the temperature code generation circuit 100 may generate the first code Code_1 and the second code Code_2 corresponding respectively to temperature before the heating operation of the heater 130 and temperature after the heating operation of the heater 130. The temperature code generation circuit 100 may control an operation time of the heater 130 in response to the heating control signal H_ ctrl, thereby controlling an increase in temperature due to the heating of the heater 130.

Figure 5:
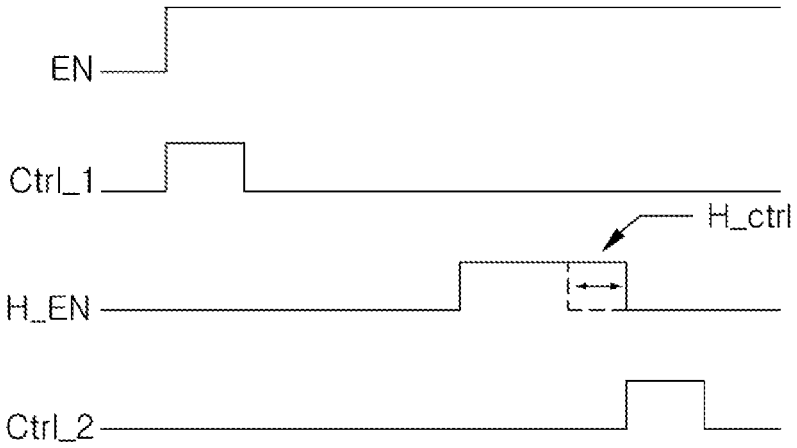
FIG. 5 is a timing diagram for explaining a semiconductor apparatus according to an embodiment of the present invention.

FIG. 5 shows a detailed operation of the temperature code generation circuit 100 of FIG. 1.

The temperature code generation circuit 100 may include the control block 110, the temperature measurement block 120, the heater 130, and the code latch block 140.

When the enable signal EN is enabled, the control block 110 may enable the first control signal Ctrl_1 and operate the temperature measurement block 120.

When the first control signal Ctrl_1 is enabled, the temperature measurement block 120 may generate the temperature code T_code corresponding to the temperature before the heating operation of the heater 130.

When the first control signal Ctrl_1 is enabled, the code latch block 140 may store the temperature code T_code and outputs the first code Code_1.

When the first control signal Ctrl_1 is disabled, the control block 110 enables the heating enable signal H_EN and operates the heater 130. The heater 130 may generate heat while the heating enable signal H_EN is being enabled. The control block 110 controls the duration of the period when the heating enable signal H_EN is being enabled in response to the heating control signal H_ ctrl, thereby controlling the operation time of the heater 130.

When the operation of the heater 130 generating heat is completed (e.g., when the heating enable signal H_EN is disabled), the control block 110 enables the second control signal Ctrl_2.

When the second control signal Ctrl_2 is enabled, the temperature measurement block 120 generates the temperature code T_code corresponding to the temperature after the heating operation of the heater 130.

When the second control signal Ctrl_2 is enabled, the code latch block 140 latches the temperature code T_code and outputs the second code Code_2.

When the enable signal EN is enabled, the temperature code generation circuit 100 generates and latches the first code Code_1 corresponding to the temperature before the heating operation of the heater 130, and generates and latches the second code Code_2 corresponding to the temperature after the heating operation of the heater 130.

The control code generation circuit 200 may perform a subtraction operation on the first code Code_1 and the second code Code_2, compare a result of the subtraction operation with the preset code Code_pre, and generate the control code Ctrl_code.

The control code generation circuit 200 may include the subtraction block 210 and the comparison block 220.

The subtraction block 210 may perform a subtraction operation on the first and second codes Code_1 and Code_2, and generate the subtraction code Code_sub.

When the subtraction code Code_sub is equal to the preset code Code_pre, the comparison block 220 generates a control code Ctrl_code which has a preset value. However, when the subtraction code Code_sub is not equal to the preset code Code_pre, the comparison block 220 generates a control code Ctrl_code which has a smaller or larger value than the preset value. For example, provided that the control code Ctrl_code has a preset value, when the subtraction code Code_sub is equal to the preset code Code_pre, the control code Ctrl_code may maintain its value (e.g., preset value). However, when the code value of the subtraction code Code_sub is larger or smaller than the code value of the preset code Code_pre, the comparison block 220 may increase or decrease the code value of the control code Ctrl_code.

The control code generation circuit 200 performs a subtraction operation on the first and second codes Code_1 and Code_2, and compares the operation result with the preset code Code_pre. The control code generation circuit 200 generates the control code Ctrl_code according to whether or not the difference between the temperature before the heating operation of the heater 130 and the temperature after the heating operation of the heater 130 is equal to a preset temperature difference.

The reference voltage generation circuit 300 changes the voltage level of the reference voltage Vref in response to the control code Ctrl_code.

Referring to FIG. 4, the reference voltage generation circuit 300 may include the bias voltage generation block 310, the voltage applying block 320, and the variable resistance block 330.

The bias voltage generation block 310 generates the bias voltage V_bias. For example, the bias voltage generation block 310 may generate the bias voltage V_bias having a constant voltage level regardless of a temperature change, and may include a Widlar circuit.

The voltage applying block 320 applies a voltage corresponding to the voltage level of the bias voltage V_bias to the output node Node_out.

The variable resistance block 330 is coupled to the output node Node_out and the ground terminal VSS. The resistance value of the variable resistance block 330, which is variable, may be determined in response to the control code Ctrl_code.

In an embodiment of the present invention, the reference voltage generation circuit 300 controls the resistance value of the variable resistance block 330 in response to the control code Ctrl_code, thereby controlling the voltage level of the reference voltage Vref.

The semiconductor apparatus according to an embodiment of the present invention determines whether or not the difference between temperatures before and after a heating operation is equal to a preset temperature difference and, based on the determination, controls the voltage level of a reference voltage.

Figure 6:
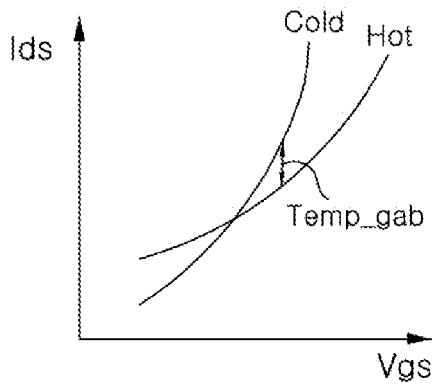
FIG. 6 is a graph for explaining a semiconductor apparatus according to an embodiment of the present invention.

FIG. 6 is a graph illustrating the characteristics of a general transistor according to a temperature change.

Even if a gate-source voltage Vgs of the transistor is constant, the amount of a current Ids flowing through a drain and a source of the transistor may vary according to a temperature difference Temp_gab between when temperature is low and when temperature is high. Even if the gate-source voltage Vgs of the transistor is constant, when the temperature is low, the amount of the current Ids flowing through the drain and the source of the transistor is large as compared with the case in which the temperature is high.

As the temperature difference Temp_gab between when the temperature is low and when the temperature is high becomes large, a change in the amount of the current Ids flowing through the drain and the source of the transistor increases.

Since the characteristics of transistors in the semiconductor apparatus may vary according to temperature, adjustments of voltage levels may maintain the current Ids of the transistor in order to perform operations as intended.

The semiconductor apparatus according to an embodiment of the present invention may detect a difference between temperature before a heating operation, which corresponds to the situation in which temperature is low, and temperature after the heating operation, which corresponds to the situation in which temperature is high, and compare the detected temperature difference with a preset temperature difference, thereby changing a voltage level of a reference voltage. The reference voltage adjusted as above may allow the semiconductor apparatus to normally operate regardless of a temperature change.

While certain embodiments have been described above, it will be understood to those skilled in the art that the embodiments described are by way of example only. Accordingly, the semiconductor apparatus described herein should not be limited based on the described embodiments. Rather, the semiconductor apparatus described herein should only be limited in light of the claims that follow when taken in conjunction with the above description and accompanying drawings.

What is claimed is:

1. A semiconductor apparatus comprising:

a control block configured to generate a first control signal, a second control signal, and a heating enable signal in response to an enable signal and a heating control signal;

a temperature measurement block configured to generate a temperature code corresponding to temperature in response to the first and second control signals;

a heater configured to generate heat while the heating enable signal is being enabled;

a code latch block configured to store the temperature code in response to the first and second control signals, and output a first code and a second code;

a control code generation circuit configured to generate a signal by performing an operation on the first and second codes, and generate a control code by comparing the signal with a preset code; and a reference voltage generation circuit configured to change a voltage level of a reference voltage in response to the control code.

2. The semiconductor apparatus according to claim 1, wherein the control block enables the first control signal when the enable signal is enabled, enables the heating enable signal after the first control signal is disabled, and enables the second control signal when the heating enable signal is disabled.

3. The semiconductor apparatus according to claim 2, wherein the duration that the heating enable signal remains enabled is determined in response to the heating control signal.

4. The semiconductor apparatus according to claim 3, wherein the control block comprises:

a first control signal generation unit configured to enable the first control signal when the enable signal is enabled;

a heating enable signal generation unit configured to decide the duration that the heating enable signal remains enabled in response to the heating control signal, and enable the heating enable signal when a predetermined time has passed after the first control signal is disabled; and a second control signal generation unit configured to enable the second control signal when the heating enable signal is disabled.

5. The semiconductor apparatus according to claim 1, wherein, when any one of the first control signal and the second control signal is enabled, the temperature measurement block generates the temperature code corresponding to temperature.

6. The semiconductor apparatus according to claim 1, wherein the code latch block comprises:

a first latch unit configured to store the temperature code and output the first code when the first control signal is enabled; and a second latch unit configured to store the temperature code and output the second code when the second control signal is enabled.

7. The semiconductor apparatus according to claim 1, wherein the control code generation circuit comprises:

a subtraction block configured to perform a subtraction operation on the first code and the second code, and generate a subtraction code; and a comparison block configured to compare the preset code with the subtraction code, and generate the control code.

8. The semiconductor apparatus according to claim 7, wherein the comparison block generates the control code, which has a preset value, when the preset code is substantially equal to the subtraction code, and generates a control code which has a smaller or larger value than the preset value when a code value of the preset code is larger or smaller than a code value of the subtraction code.

9. The semiconductor apparatus according to claim 1, wherein the reference voltage generation circuit comprises:

a bias voltage generation block configured to generate a bias voltage;

a voltage applying block configured to apply a voltage to an output node in response to a voltage level of the bias voltage; and a variable resistance block coupled to the output node and a ground terminal, wherein a resistance value of the variable resistance block is determined in response to the control code, and wherein the reference voltage is outputted from the output node.

10. A semiconductor apparatus comprising:

a temperature code generation circuit configured to generate a first code corresponding to temperature before a heating operation and generate a second code corresponding to temperature after the heating operation in response to an enable signal;

a control code generation circuit configured to generate a control code in response to the first code and the second code; and a reference voltage generation circuit configured to generate a reference voltage having a voltage level corresponding to the control code, wherein the control code generation circuit compares a subtraction code, which is generated by performing a subtraction operation on the first and second control codes, with a preset code, and generates the control code.

11. The semiconductor apparatus according to claim 10, wherein the temperature code generation circuit comprises:

a heater configured to generate heat;

a temperature measurement block configured to generate a temperature code corresponding to temperature;

a latch block configured to store the temperature code before and after the heating operation, and output the first and second codes; and a control block configured to control the heater, the temperature measurement block, and the latch block in response to the enable signal.

12. The semiconductor apparatus according to claim 11, wherein the control block generates a heating enable signal, a first control signal, and a second control signal in response to the enable signal.

13. The semiconductor apparatus according to claim 12, wherein the control block enables the first control signal when the enable signal is enabled, enables the heating enable signal after the first control signal is disabled, and enables the second control signal when the heating enable signal is disabled.

14. The semiconductor apparatus according to claim 13, wherein the control block comprises:

a first control signal generation unit configured to generate the first control signal that is enabled when the enable signal is enabled;

a heating enable signal generation unit configured to generate the heating enable signal that is enabled after the first control signal is disabled; and a second control signal generation unit configured to generate the second control signal that is enabled when the heating enable signal is disabled.

15. The semiconductor apparatus according to claim 14, wherein the heating enable signal generation unit generates the heating enable signal having an enable period, the duration of which is determined in response to a heating control signal, the duration of which is determined in response to the first control signal.

16. The semiconductor apparatus according to claim 13, wherein the heater generates heat for the enable period of the heating enable signal.

17. The semiconductor apparatus according to claim 13, wherein, when one of the first and second control signals is enabled, the temperature measurement block generates the temperature code corresponding to temperature.

18. The semiconductor apparatus according to claim 13, wherein the latch block stores the temperature code and outputs the first code when the first control signal is enabled, and stores the temperature code and outputs the second code when the second control signal is enabled.

19. The semiconductor apparatus according to claim 10, wherein the reference voltage generation circuit comprises:

a bias voltage generation block configured to generate a bias voltage;

a voltage applying block configured to apply a voltage corresponding to a voltage level of the bias voltage to an output node; and a variable resistance block coupled to the output node and a ground terminal, wherein a resistance value of the variable resistance block is determined in response to the control code, and wherein the reference voltage is outputted from the output node.

* * * * *